US007365501B2

(12) United States Patent
Ushijima et al.

(10) Patent No.: US 7,365,501 B2
(45) Date of Patent: Apr. 29, 2008

(54) INVERTER TRANSFORMER

(75) Inventors: Masakazu Ushijima, Nakano-ku (JP); Chun-Yi Chang, Taipei Hsien (TW)

(73) Assignee: Greatchip Technology Co., Ltd., Taichung (TW)

( * ) Notice: Subject to any disclaimer, the term of this patent is extended or adjusted under 35 U.S.C. 154(b) by 231 days.

(21) Appl. No.: 11/240,942

(22) Filed: Sep. 29, 2005

(65) Prior Publication Data

US 2006/0066246 A1 Mar. 30, 2006

(30) Foreign Application Priority Data

Sep. 30, 2004 (TW) ..... 93129568 A
Jan. 17, 2005 (TW) ..... 94200841 U
Feb. 5, 2005 (TW) ..... 94202391 U

(51) Int. Cl.
*H05B 41/16* (2006.01)

(52) U.S. Cl. ..... 315/278; 315/312; 336/170; 336/173; 336/212

(58) Field of Classification Search ..... 336/165, 336/170–173, 178, 192, 198, 205, 210, 212–214, 336/83, 84 R; 315/209 R, 312, 278, 291
See application file for complete search history.

(56) References Cited

U.S. PATENT DOCUMENTS 4,041,364 A * 8/1977 Gauper, Jr. ..... 363/15
4,766,406 A * 8/1988 Kurgan et al. ..... 336/65
4,857,876 A * 8/1989 Costa ..... 336/165
5,359,313 A * 10/1994 Watanabe et al. ..... 336/178
6,459,213 B1 * 10/2002 Nilssen ..... 315/224
6,894,596 B2 * 5/2005 Suzuki ..... 336/83
7,015,785 B2 * 3/2006 Wu et al. ..... 336/212
7,141,933 B2 * 11/2006 Ball ..... 315/57
2002/0016738 A1 2/2002 Coile

FOREIGN PATENT DOCUMENTS

JP 54032750 3/1979
JP 63175405 7/1988
JP 09035885 2/1997
JP 11297550 10/1999
JP 2002043148 2/2002
JP 2002075672 3/2002
JP 2004281134 A * 10/2004
TW 592379 6/2004
TW M251271 U 11/2004

* cited by examiner

*Primary Examiner*—Haissa Philogene
(74) *Attorney, Agent, or Firm*—Darby & Darby P.C.

(57) ABSTRACT

An inverter transformer includes a coil unit including a bobbin and a plurality of windings, and a transformer core unit. The bobbin is formed with a core-receiving compartment, and includes first, second and third coil winding portions. The windings are wound around the first, second and third coil winding portions, respectively. The transformer core unit has an internal core part that extends into the core-receiving compartment.

6 Claims, 23 Drawing Sheets

INVERTER TRANSFORMER

CROSS-REFERENCE TO RELATED APPLICATIONS

This application claims priority of Taiwanese Application No. 093129568, filed on Sep. 30, 2004, Taiwanese Application No. 094200841, filed on Jan. 17, 2005, and Taiwanese Application No. 094202391, filed on Feb. 5, 2005.

BACKGROUND OF THE INVENTION

1. Field of the Invention

The invention relates to an inverter transformer, more particularly to an inverter transformer adapted to be connected to discharge lamps to form a lamp assembly that has uniform illumination among the lamps.

2. Description of the Related Art

A liquid crystal display (LCD) uses discharge lamps, such as cold cathode fluorescent lamps (CCFL), as a source of backlight illumination. The discharge lamps are driven by an inverter circuit, which usually includes an inverter transformer, in order to meet the requirement of high voltage outputs.

A conventional inverter transformer includes a core, a bobbin, and primary and secondary windings wound around the bobbin. The primary and secondary windings are adapted to be connected electrically and respectively to an electrical source and a load, which is the CCFL in this case.

As LCDs increase in physical size, the required length and number of CCFLs also increases, and the power required for driving the lamps increases accordingly.

In order to minimize production costs, the secondary winding is connected in the prior art to two CCFLs that are in parallel. Under ideal loading conditions, the CCFL exhibits negative thermal impedance characteristics, which can result in different actual impedances between individual lamps. Therefore, the current, and thus illumination, in individual lamps differ from each other during actual operation.

The CCFL comes in various configurations, such as L-shaped and U-shaped, depending on a particular application. The difference in illumination among individual lamps is more noticeable for the L-shaped and U-shaped lamps, and therefore, control over regulating the currents in the lamps is necessary. Although an impedance matching coil has been proposed heretofore to facilitate regulating the currents in the lamps that are connected to the same secondary winding, this regulating scheme not only increases production cost, but also takes up valuable space in circuit boards inside the LCDs.

SUMMARY OF THE INVENTION

Therefore, the object of the present invention is to provide an inverter transformer that is adapted to supply balanced current outputs to discharge lamps in a lamp assembly so as to ensure uniform illumination.

According to one aspect of the present invention, there is provided an inverter transformer that includes a coil unit including a bobbin and a plurality of windings, and a transformer core unit. The bobbin is formed with a core-receiving compartment, and includes first, second and third coil winding portions. The windings are wound around the first, second and third coil winding portions, respectively. The transformer core unit has an internal core part that extends into the core-receiving compartment.

According to another aspect of the present invention, there is provided an inverter transformer that includes a plurality of coil units and a plurality of transformer core units. Each of the coil units includes a bobbin and a plurality of windings. The bobbin is formed with a core-receiving compartment, and includes first, second and third coil winding portions. The windings include primary, secondary and tertiary windings wound around the first, second and third coil winding portions, respectively. Each of the transformer core units has an internal core part that extends into the core-receiving compartment of a respective one of the coil units.

According to yet another aspect of the present invention, there is provided a lamp assembly that includes a pair of lamp loads and an inverter transformer. The inverter transformer includes first and second coil units connected respectively to the lamp loads, and first and second transformer core units. Each of the first and second coil units includes a bobbin and a plurality of windings. The bobbin is formed with a core-receiving compartment, and includes first, second and third coil winding portions. The windings include primary, secondary and tertiary windings wound around the first, second and third coil winding portions, respectively. Each of the first and second transformer core units has an internal core part that extends into the core-receiving compartment of a respective one of the first and second coil units.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
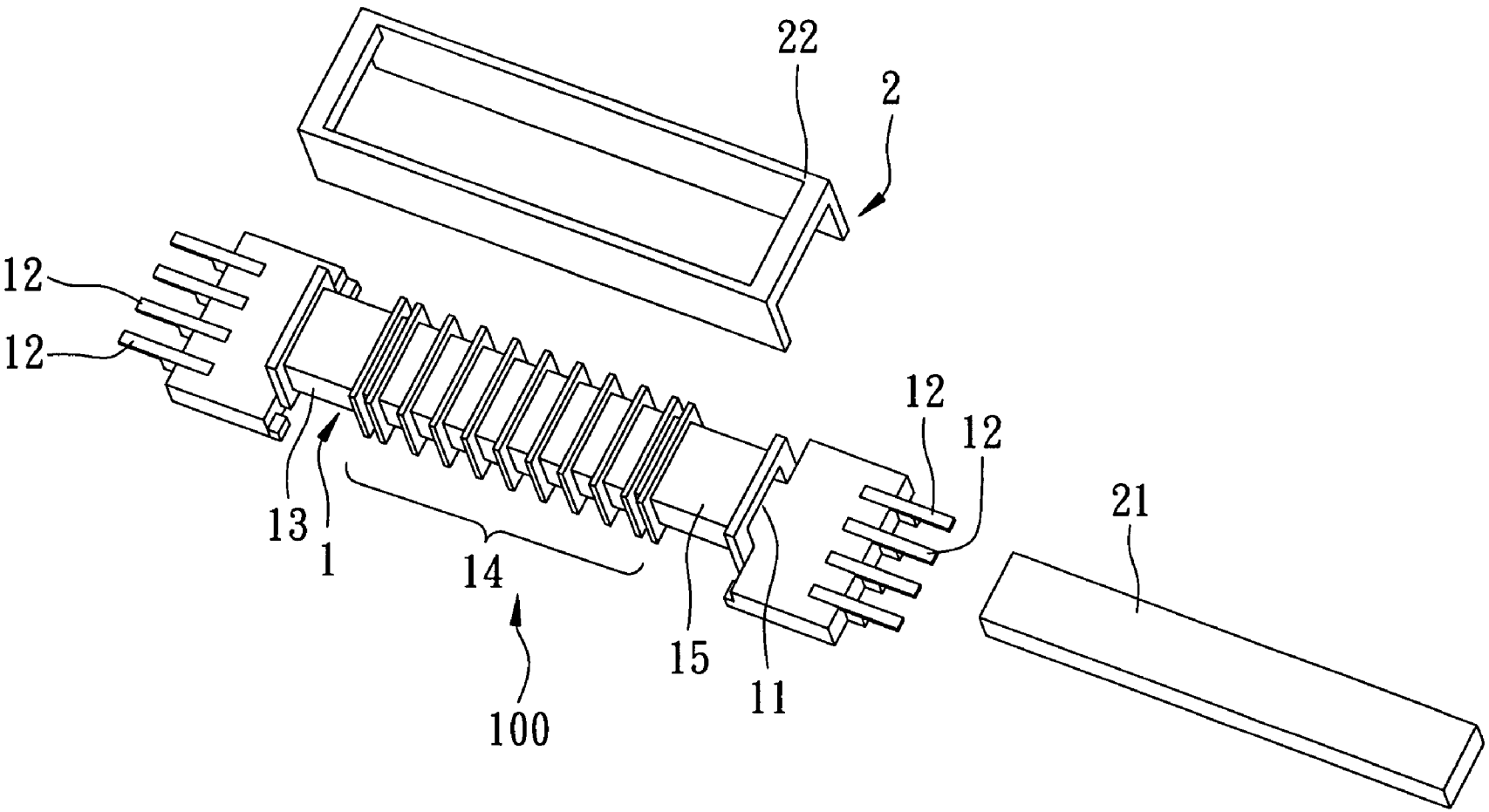
FIG. 1 is a fragmentary exploded perspective view of the first preferred embodiment of an inverter transformer according to the present invention.

Before the present invention is described in greater detail, it should be noted herein that like elements are denoted by the same reference numerals throughout the disclosure.

Figure 2:
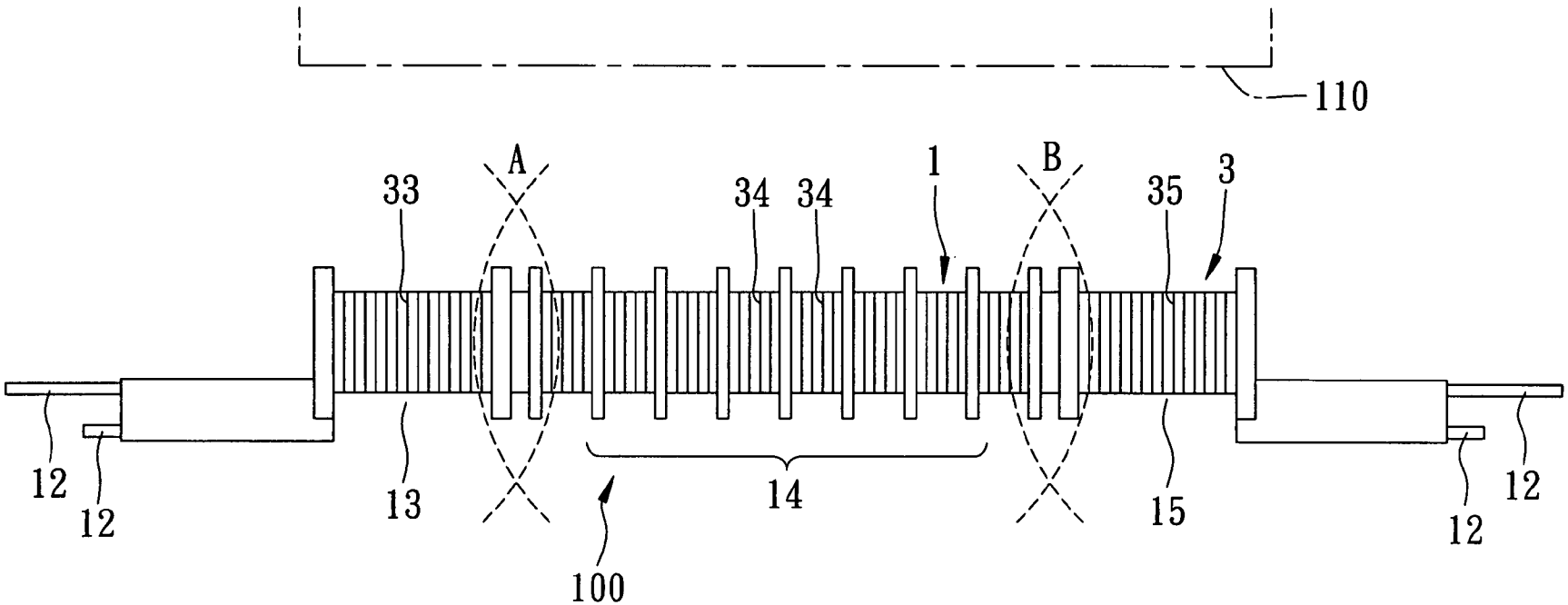
FIG. 2 is a fragmentary schematic side view of the first preferred embodiment, illustrating magnetic coupling between adjacent windings.

As shown in FIG. 1 and FIG. 2, the first preferred embodiment of an inverter transformer 100 according to the present invention includes a transformer core unit 2, and a coil unit including a bobbin 1 and a plurality of windings 3.

The bobbin 1 is formed with a core-receiving compartment 11, and is sectioned into first, second, and third coil winding portions 13, 14, 15. In this embodiment, the windings 3 include primary, secondary, and tertiary windings 33, 34, 35 wound around the first, second, and third coil winding portions 13, 14, 15, respectively. The second coil winding portion 14 is disposed between the first and third coil winding portions 13, 15. The bobbin 1 extends in a horizontal direction, and is further provided with a plurality of lead terminals 12 on opposite ends for external connection purposes.

The transformer core unit 2 includes internal and external core parts 21, 22, disposed respectively inside and outside the core-receiving compartment 11 of the bobbin 1 to provide a magnetic circuit path for the inverter transformer 100. In this embodiment, the internal and external core parts 21, 22 are configured as I-shaped and hollow U-shaped cores, respectively.

As shown in FIG. 2, the inverter transformer 100 is further provided with a magnetic shield 110 that surrounds the bobbin 1 for protection against electromagnetic interference. When the primary winding 33 is supplied with electric current from an external electric source (not shown), magnetic couplings (A), (B) are established through the transformer core unit 2 between the primary and secondary windings 33, 34, and between the secondary and tertiary windings 34, 35. The magnetic couplings (A), (B) help stabilize outputs of the inverter transformer 100, such that when the inverter transformer 100 is connected to discharge lamps (not shown), illumination matching is ensured among the lamps.

Figure 3:
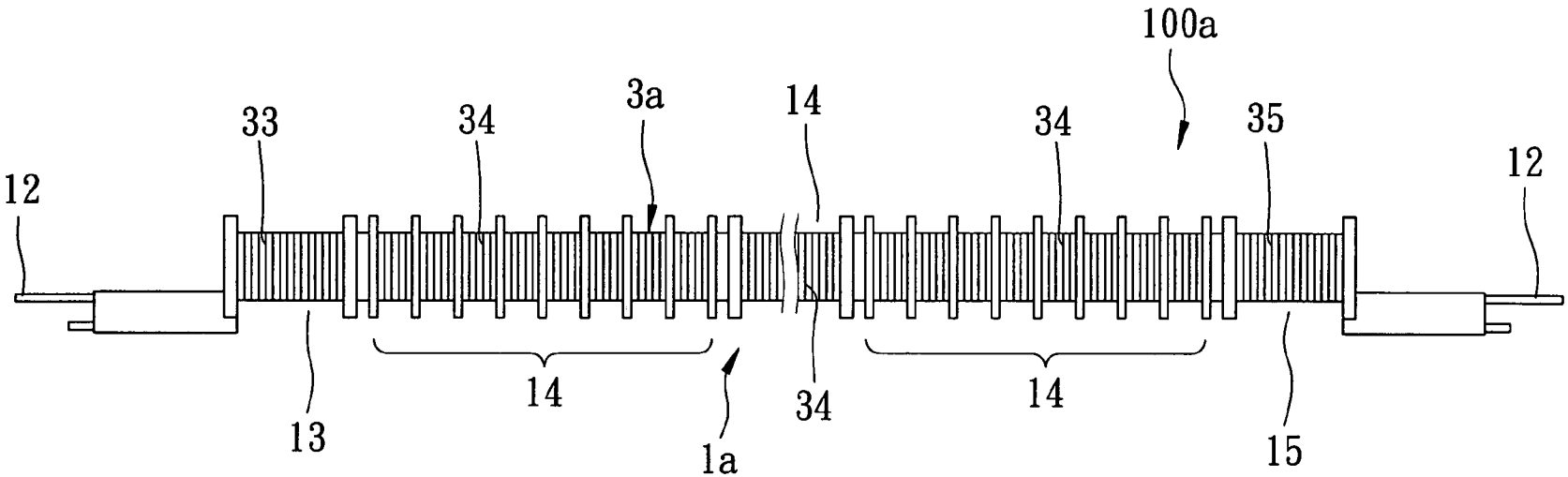
FIG. 3 is a fragmentary schematic side view of the second preferred embodiment of an inverter transformer according to the present invention.

As shown in FIG. 3, the second preferred embodiment of an inverter transformer 100*a* according to the present invention differs from the first preferred embodiment in that the bobbin 1*a* includes a plurality of the second coil winding portions 14 disposed between the first and third coil winding portions 13, 15, and the windings 3*a* include a plurality of the secondary windings 34 that are wound around the second coil winding portions 14, respectively. The number of the secondary coil winding portions 14 included in the bobbin 1*a* depends on the load conditions and power utilization for a particular application.

Figure 4:
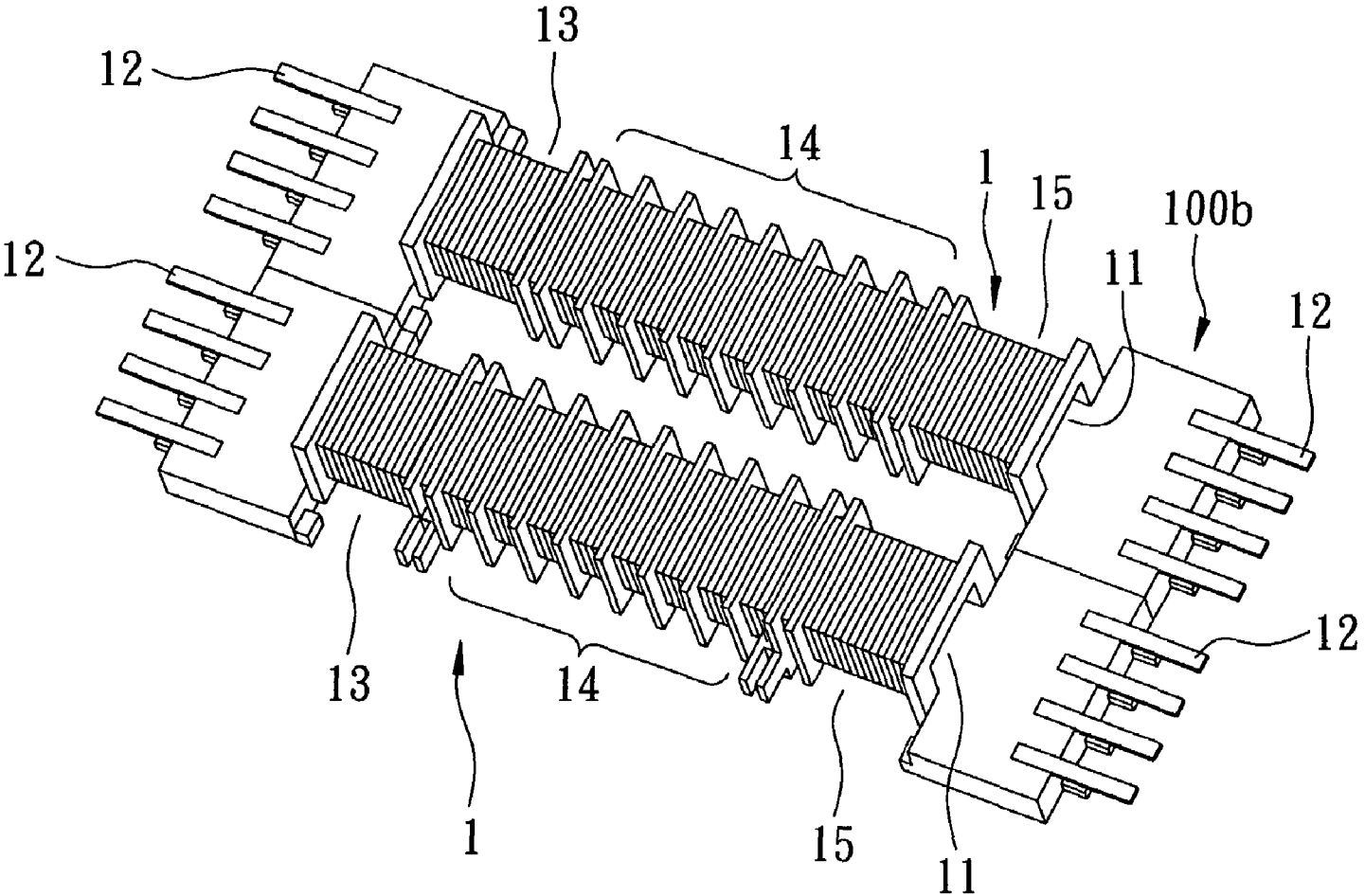
FIG. 4 is a fragmentary perspective view of the third preferred embodiment of an inverter transformer according to the present invention.

As shown in FIG. 4, the third preferred embodiment of an inverter transformer 100*b* according to the present invention includes two of the coil units (shown in FIG. 1) in the first preferred embodiment, so that the inverter transformer 100*b* can be adapted to drive two or more discharge lamps. The number of coil units included in the third preferred embodiment depends on the requirements of a particular application.

Figure 5:
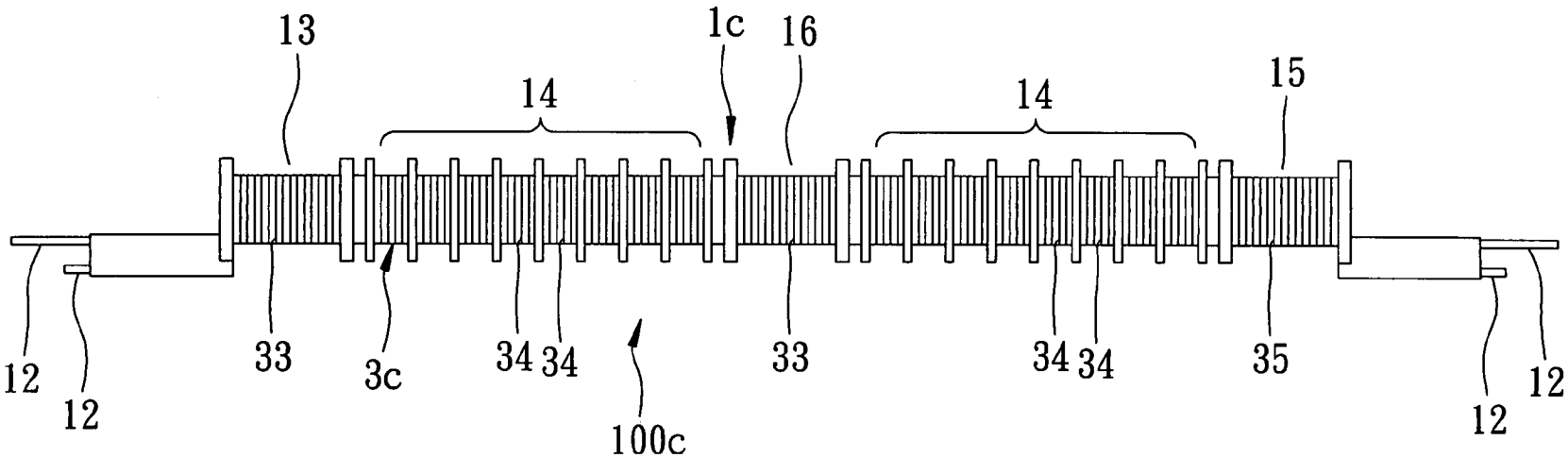
FIG. 5 is a fragmentary schematic side view of the fourth preferred embodiment of an inverter transformer according to the present invention.

As shown in FIG. 5, the fourth preferred embodiment of an inverter transformer 100*c* according to the present invention differs from the second preferred embodiment (shown in FIG. 3) in that the bobbin 1*c* includes a fourth coil winding portion 16 disposed between an adjacent pair of the second coil winding portions 14. In addition, the windings 3*c* include a pair of the primary windings 33 that are wound around the first and fourth coil winding portions 13, 16, respectively. When the inverter transformer 100*c* is applied to a lamp assembly, the magnetic couplings between adjacent pairs of the primary, secondary, and tertiary windings 33, 34, 35 provide a plurality of magnetic circuit loops, such that a plurality of discharge lamps can be illuminated by the inverter transformer 100*c*.

Figure 7:
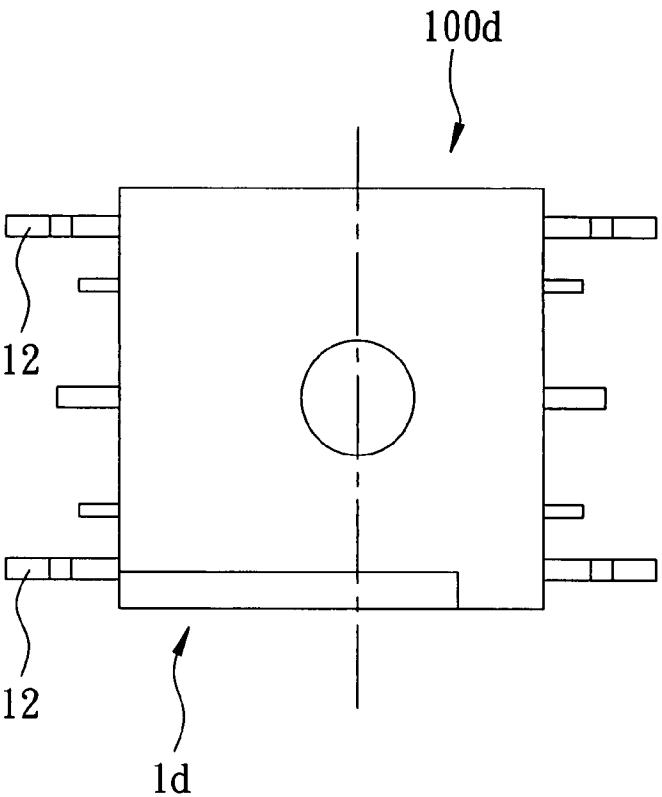
FIG. 7 is a fragmentary schematic bottom view of the fifth preferred embodiment.
Figure 6:
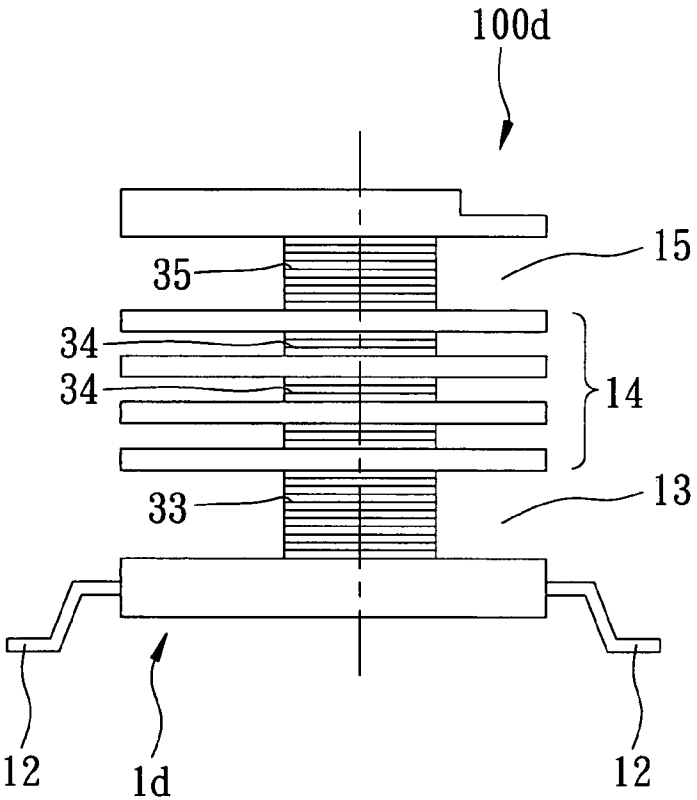
FIG. 6 is a fragmentary schematic side view of the fifth preferred embodiment of an inverter transformer according to the present invention.

As shown in FIG. 6 and FIG. 7, the fifth preferred embodiment of an inverter transformer 100*d* according to the present invention differs from the first preferred embodiment (shown in FIG. 1) in that the bobbin 1*d* extends in an upright direction, and that the lead terminals 12 are provided only on a bottom end of the bobbin 1*d*.

Figure 8:
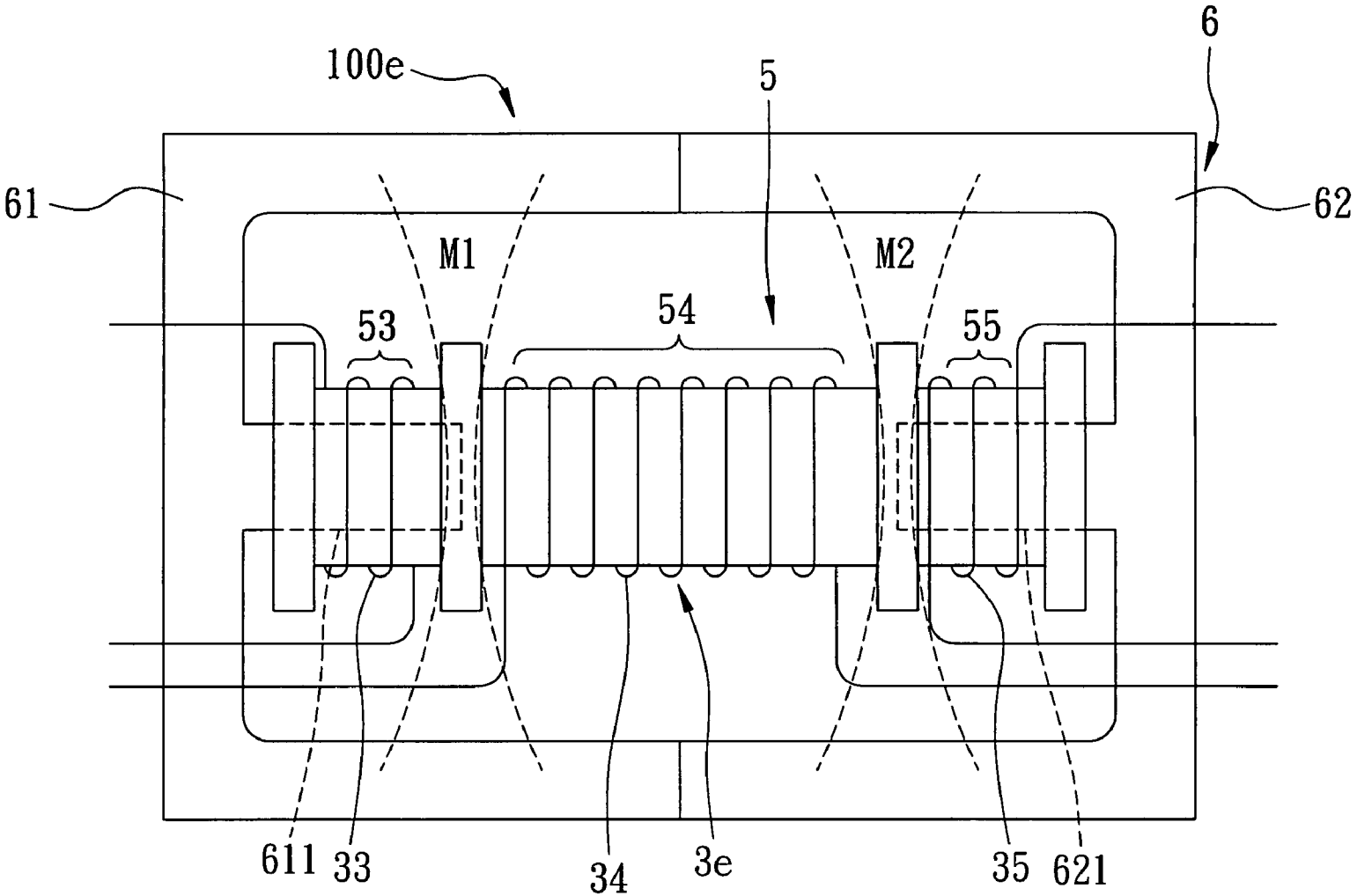
FIG. 8 is a top view of the sixth preferred embodiment of an inverter transformer according to the present invention.

As shown in FIG. 8, the sixth preferred embodiment of an inverter transformer 100*e* according to the present invention includes a coil unit including a bobbin 5 and windings 3*e*, and a transformer core unit 6.

The bobbin 5 is formed with a core-receiving compartment 51 (refer to FIG. 9), and is sectioned into first, second and third coil winding portion 53, 54, 55. The windings 3*e* include primary, secondary, and tertiary windings 33, 34, 35 that are wound respectively around the first, second, and third coil winding portion 53, 54, 55. The bobbin 5 is further provided with a plurality of lead terminals 52 (refer to FIG. 9) on opposite ends.

The transformer core unit 6 includes first and second core parts 61, 62, which are configured as two E-shaped cores having reverse orientations. The first and second core parts 61, 62 have protrusion segments 611, 621 that extend respectively from the middle of the core parts 61, 62 into the core-receiving compartment 51 at positions corresponding to the first and third coil winding portions 53, 55. Air gaps (M1), (M2) are formed between the primary and secondary windings 53, 54, and the secondary and tertiary windings 54, 55, respectively. By adjusting the widths of the air gaps (M1), (M2), induced currents in the windings 3*e* can be adjusted for lamp impedance matching.

Figure 9:
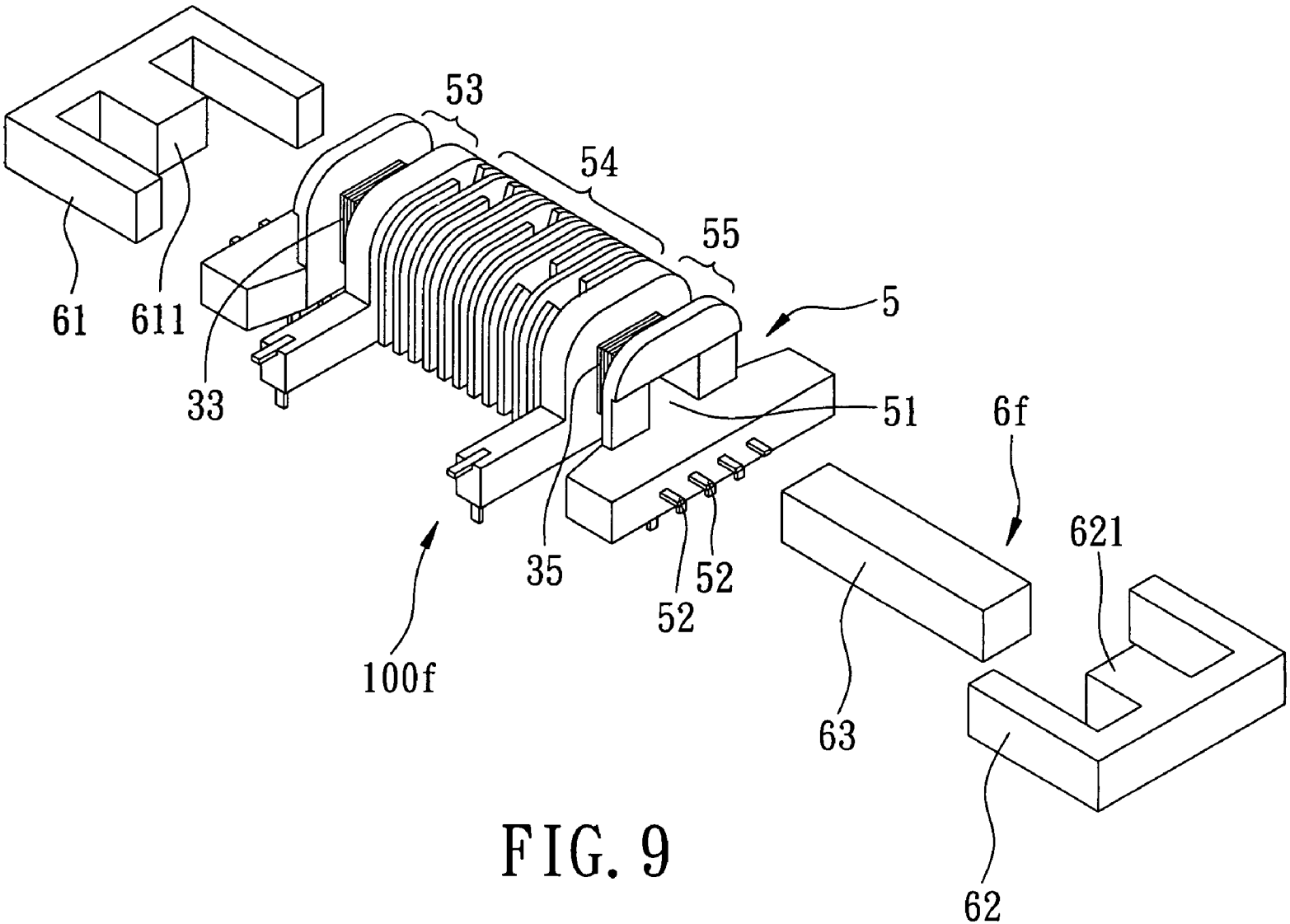
FIG. 9 is an exploded perspective view of the seventh preferred embodiment of an inverter transformer according to the present invention.
Figure 10:
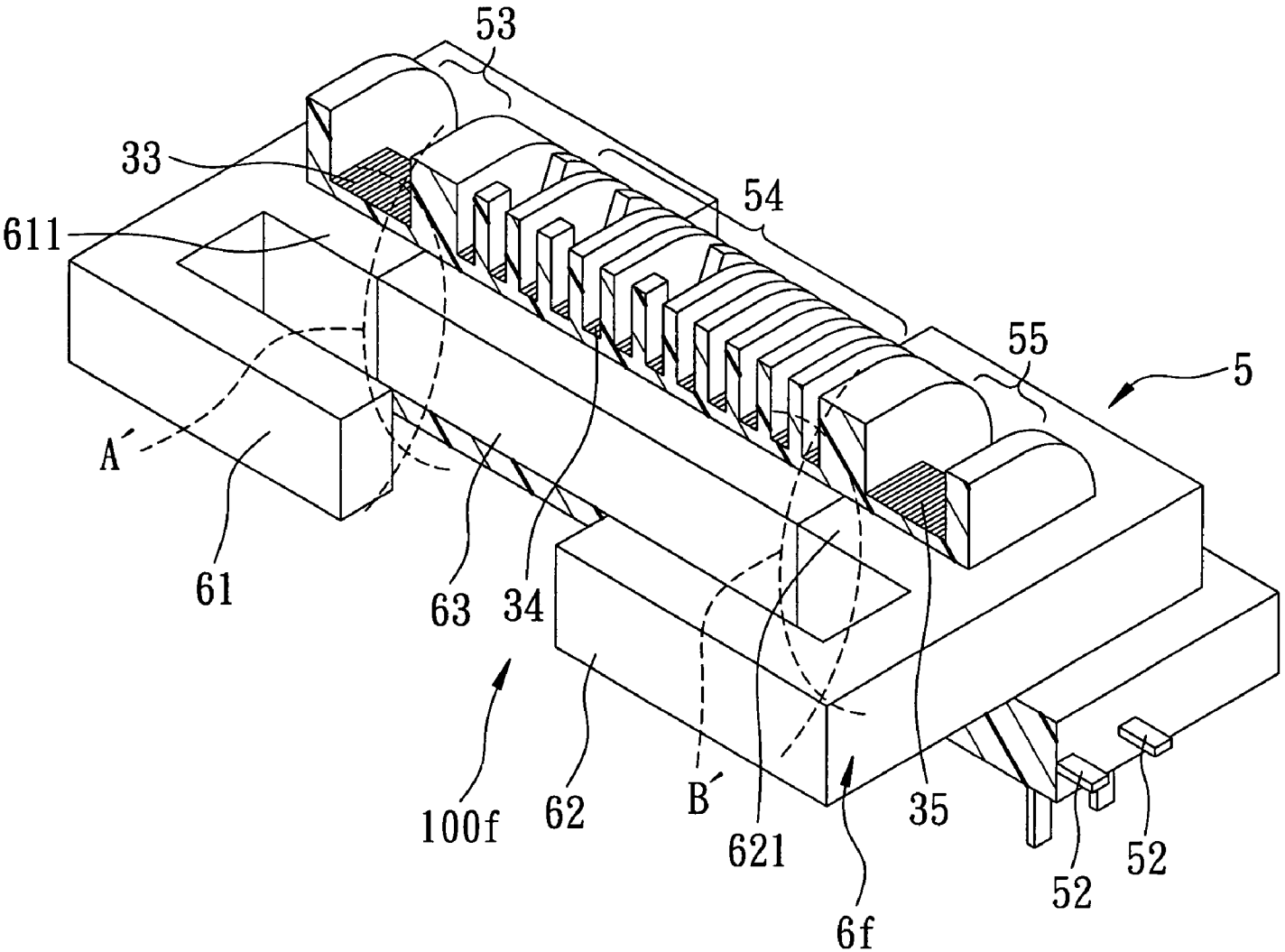
FIG. 10 is a partly cutaway, assembled perspective view of the seventh preferred embodiment.

As shown in FIG. 9 and FIG. 10, the seventh preferred embodiment of an inverter transformer 100*f* according to the present invention differs from the sixth preferred embodiment in that the transformer core unit 6*f* further includes an internal core part 63 configured as an I-shaped core and disposed in the core-receiving compartment 51. In this embodiment, the internal core part 63 interconnects the protruding portions 611, 621 of the first and second core parts 61, 62. Similar to the first preferred embodiment, when the primary winding 33 is supplied with electric current from an external electric source (not shown), magnetic couplings (A'), (B') are established through the transformer core unit 6*f* between the primary and secondary windings 33, 34, and between the secondary and tertiary winding 34, 35 to stabilize outputs of the inverter transformer 100*f*.

It should be noted that there can be spaces between the internal core part 63 and the adjacent protrusions 621, 622 to form air gaps in other embodiments of the present invention. The widths of the air gaps can be adjusted so as to adjust the induced currents in the windings for lamp impedance matching.

Figure 11:
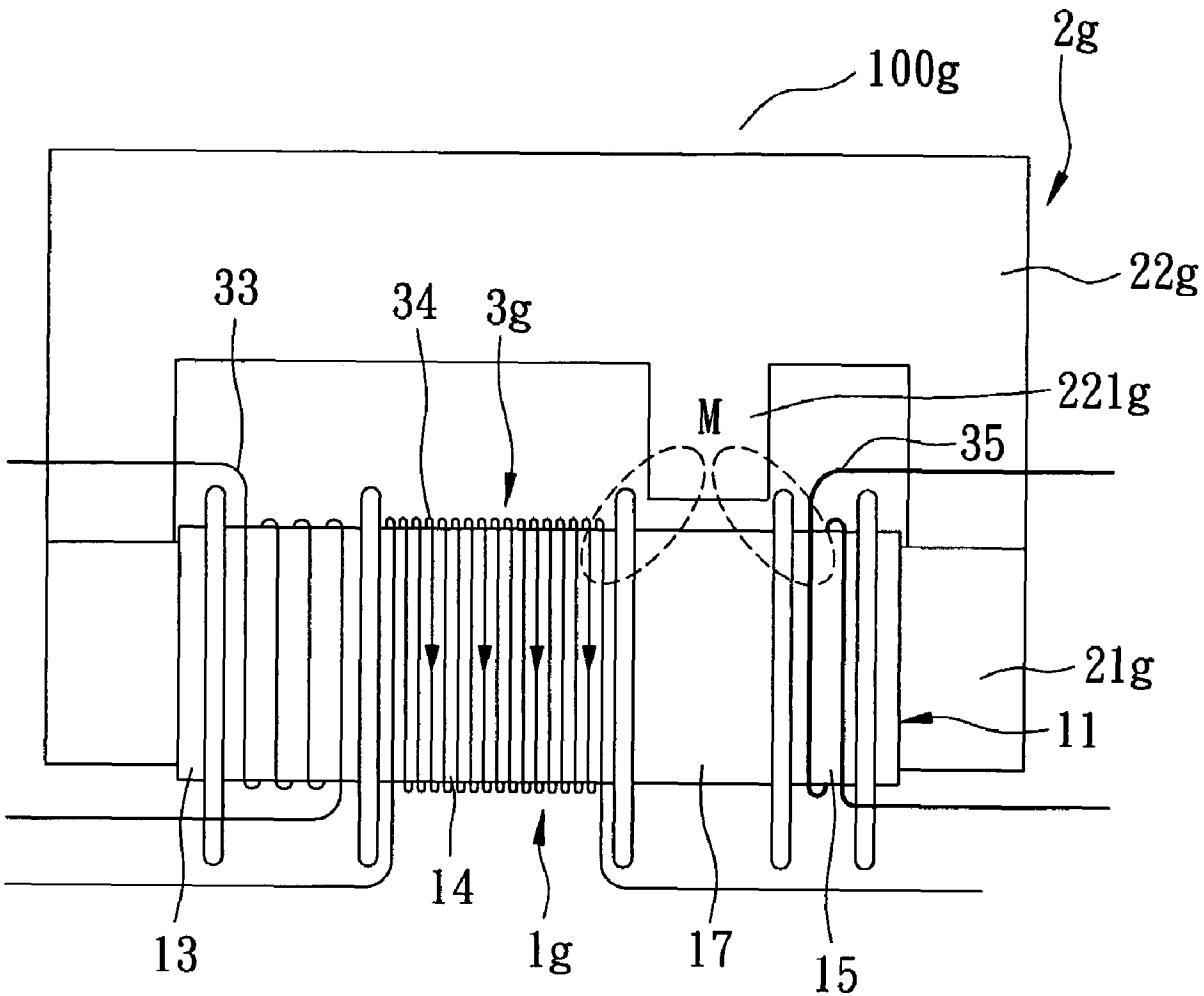
FIG. 11 is a top view of the eighth preferred embodiment of an inverter transformer according to the present invention.

As shown in FIG. 11, the eighth preferred embodiment of an inverter transformer 100*g* according to the present invention differs from the first preferred embodiment (shown in FIG. 1) in that the external core part 22*g* of the transformer core unit 2*g* is configured as an E-shaped core and has a protrusion 221*g*, and that the internal core part 21*g* extends through and out of the core-receiving compartment 11, and is connected to the external core part 22*g*. In addition, the bobbin 1*g* further includes a spacer portion 17 between an adjacent pair of the first, second, and third coil winding portions 13, 14, 15 and having none of the windings 3*g* wound therearound. In this embodiment, the spacer portion 17 is disposed between the second and third coil winding portions 14, 15. The protruding portion 221*g* forms air gaps (M) with the secondary and tertiary windings 34, 35, respectively.

Figure 12:
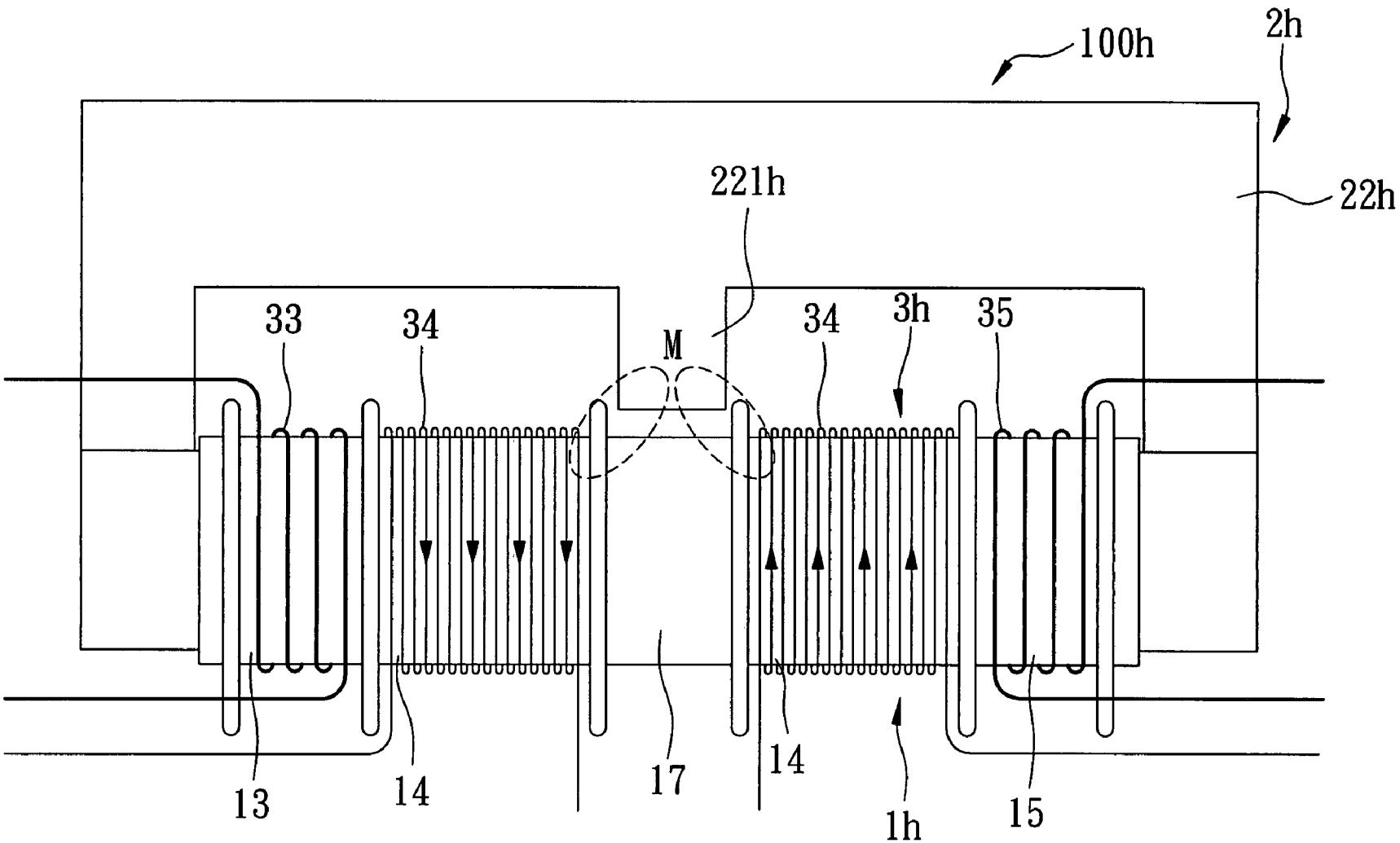
FIG. 12 is a top view of the ninth preferred embodiment of an inverter transformer according to the present invention.
Figure 14:
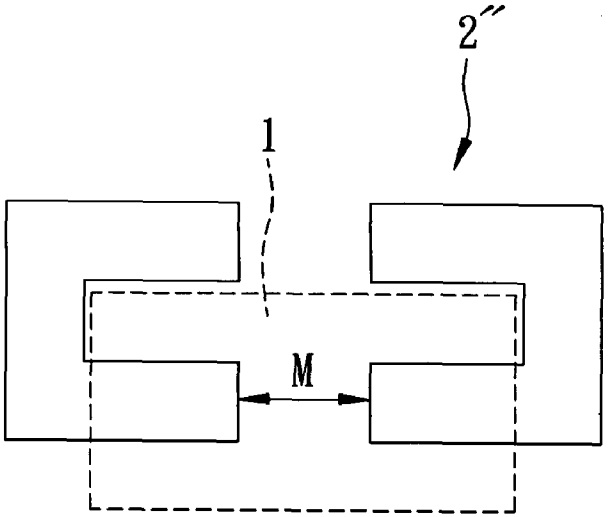
FIG. 14 is a schematic view of a transformer core unit that includes two U-shaped cores.
Figure 13:
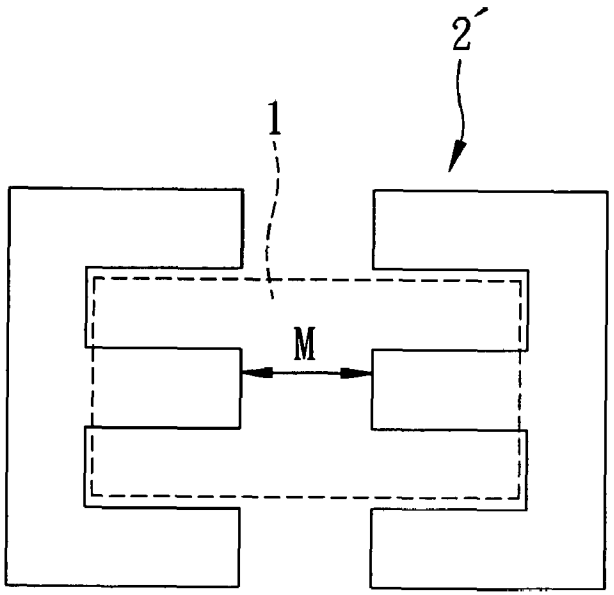
FIG. 13 is a schematic view of a transformer core unit that includes two E-shaped cores.
Figure 16:
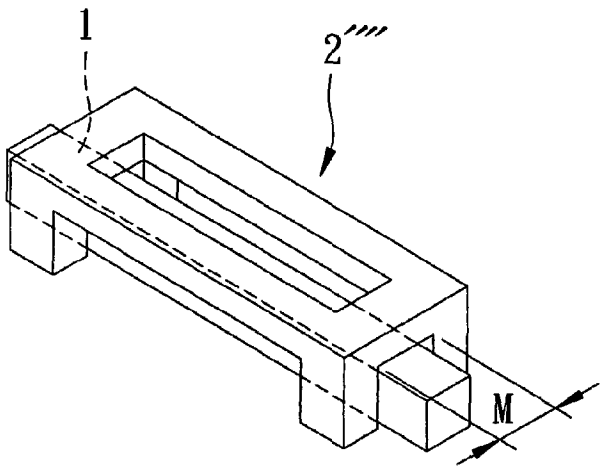
FIG. 16 is a perspective view of a transformer core unit that includes an I-shaped core and a hollow U-shaped core.
Figure 15:
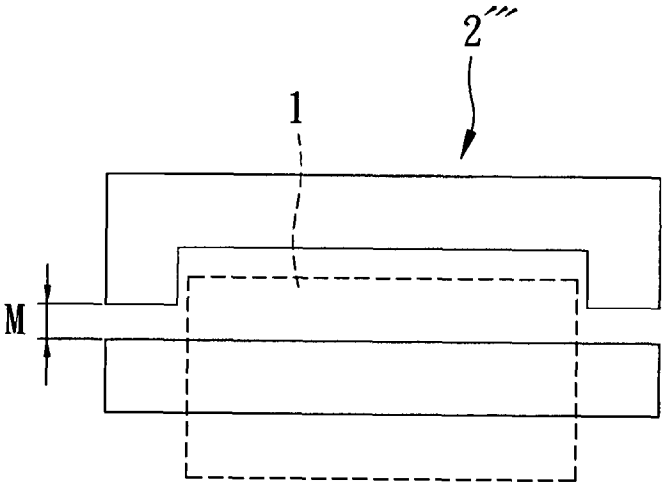
FIG. 15 is a schematic view of a transformer core unit that includes an I-shaped core and an U-shaped core.

Similarly, as shown in FIG. 12, the ninth preferred embodiment of an inverter transformer 100*h* according to the present invention differs from the eighth preferred embodiment in that the bobbin 1*h* has a pair of the second coil winding portions 14 disposed between the first and third winding portions 13, 15, and that the spacer portion 17 is disposed between the pair of the second coil winding portions 14. The protruding portion 221*h* of the external core part 22*h* of the transformer core unit 2*h* forms air gaps (M) with each of the secondary windings 34 of the windings 3*h*.

Shown in FIG. 13 to FIG. 16 are various configurations of the transformer core unit 2', 2", 2"', 2"" to illustrate possible arrangements for the inverter transformer and possible locations of the air gap (M). The bobbins 1 are presented using the dotted lines in these figures. Since the feature of the present invention does not reside in the particular configuration of the transformer core unit 2, and in the location of the air gap (M), the same should not be relied upon to limit the scope of the present invention.

Therefore, as shown in the previous embodiments, the present invention uses specific configurations of the first, second, and third coil winding portions 13, 14, 15, with the possible addition of the fourth coil winding portion 17 to stabilize the outputs of the inverter transformer 100, such that when connected to discharge lamps, the illumination among individual lamps can be made uniform. The present invention also allows variations in the number, length, and orientation of components in the inverter transformer 100 so as to drive a plurality of discharge lamps to suit the requirements of a particular application.

Figure 17:
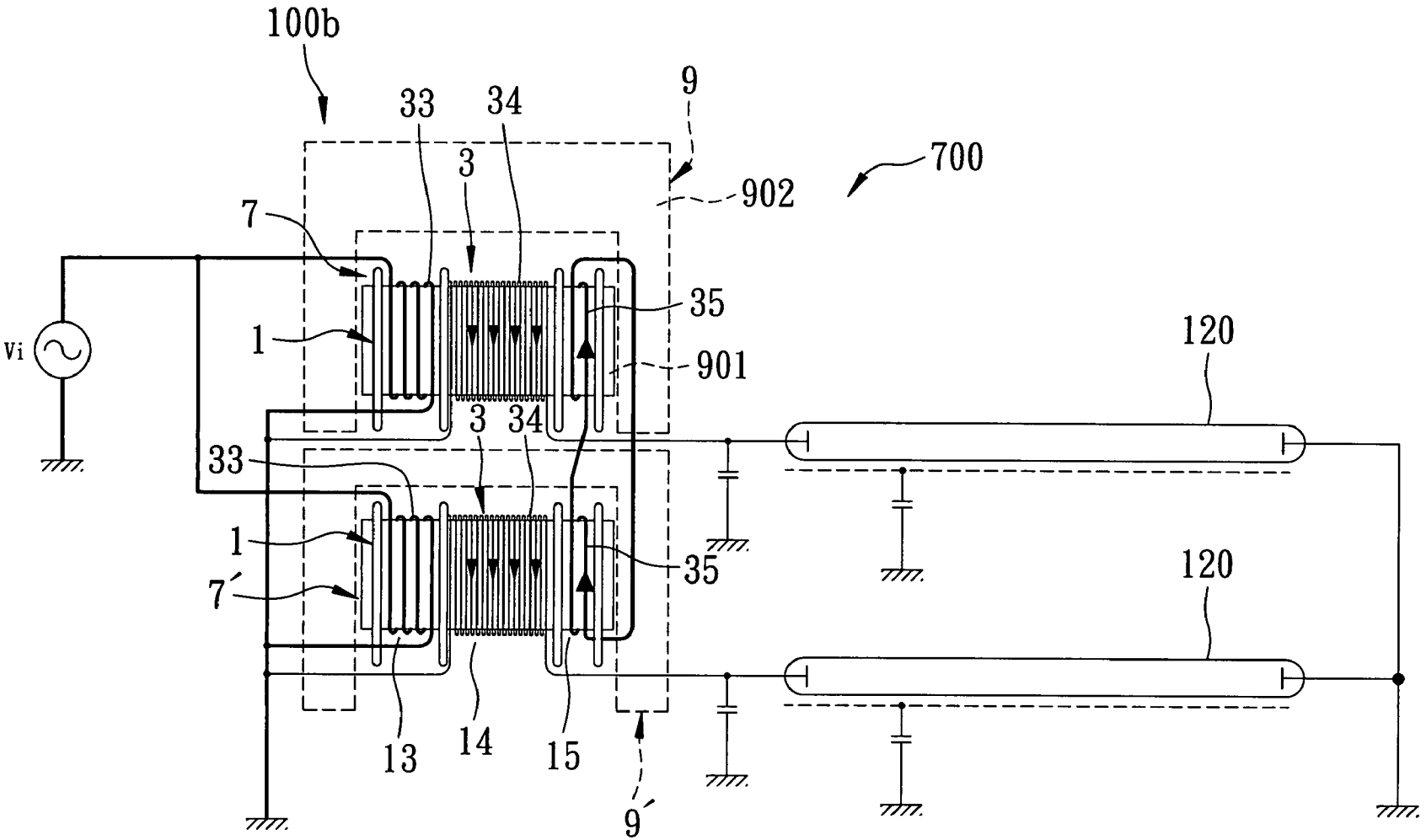
FIG. 17 is a schematic diagram of a lamp assembly according to the tenth preferred embodiment of the present invention.
Figure 18:
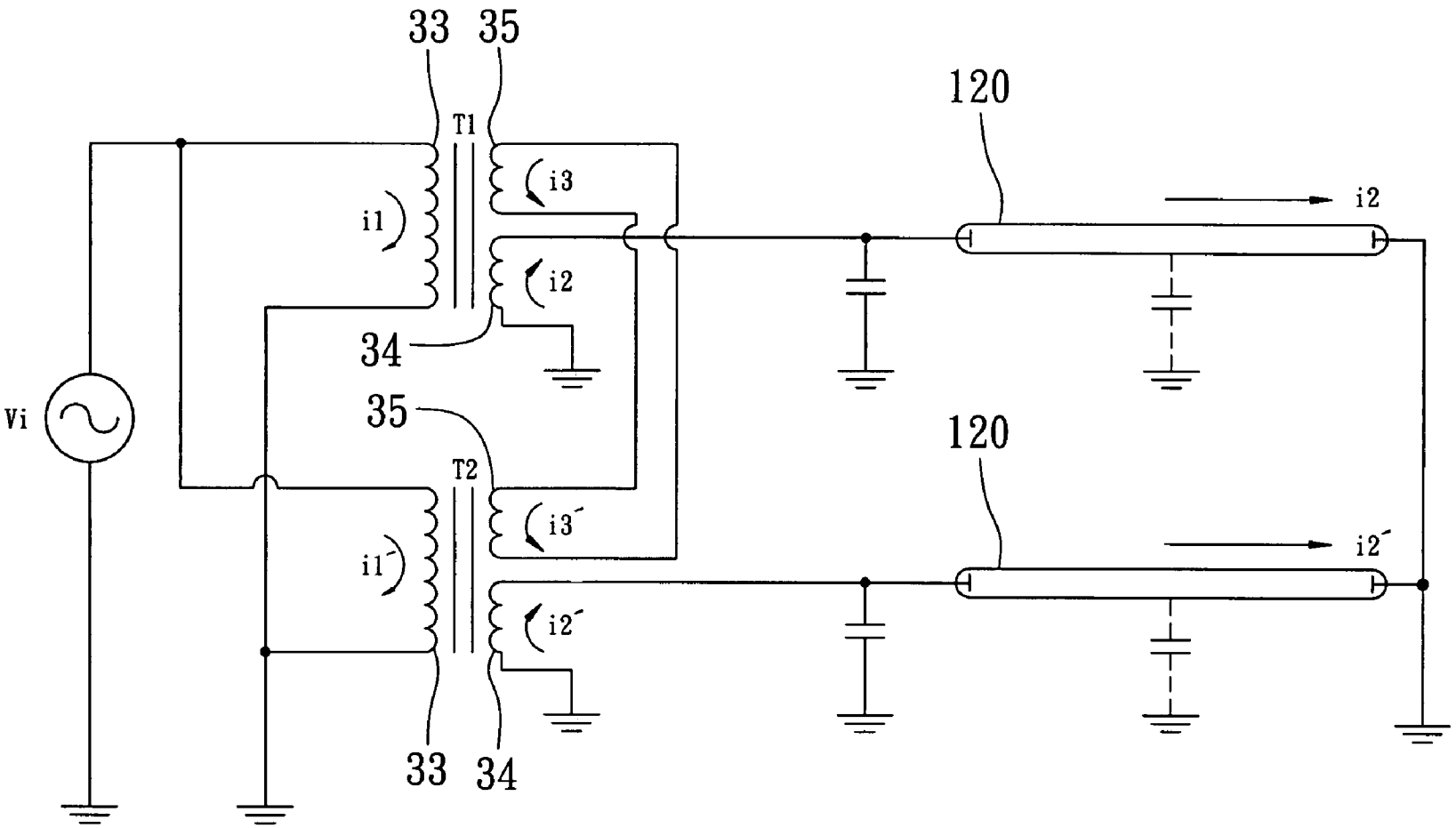
FIG. 18 a schematic electric circuit diagram of the tenth preferred embodiment.

As shown in FIG. 17 and FIG. 18, a lamp assembly 700 according to the tenth preferred embodiment of the present invention includes a pair of lamp loads 120 and the inverter transformer 100*b* (shown in FIG. 4) of the third preferred embodiment. The inverter transformer 100*b* includes first and second coil units 7, 7' connected respectively to the lamp loads 120, and first and second transformer core units 9, 9'. Each of the first and second coil units 7, 7' includes a bobbin 1 and a plurality of windings 3. The bobbin 1 is formed with a core-receiving compartment (not shown), and includes first, second, and third coil winding portions 13, 14, 15. The second coil winding portion 14 is disposed between the first and third coil winding portions 13, 15. The windings 3 include primary, secondary, and tertiary windings 33, 34, 35 wound around the first, second, and third coil winding portions 13, 14, 15, respectively.

Each of the first and second transformer core units 9, 9' has internal and external core parts 901, 902. The internal core part 901 is an I-shaped core, and extends into the core-receiving compartment of a respective one of the first and second coil units 7, 7'. The external core part 902 is an U-shaped core and is coupled to the bobbin 1.

In this embodiment, the tertiary windings 35 of the first and second coil units 7, 7' are interconnected in parallel to form a closed loop.

When the primary winding 33 of each of the first and second coil units 7, 7' is connected to an electric source (Vi) and to ground at opposite ends, a magnetic field is induced by primary currents (i1, i1') flowing in the primary windings 33. Secondary current (i2, i2') is then induced in the secondary winding 34 of each of the first and second coil units 7, 7' by the induced magnetic field. Since each of the secondary windings 34 interconnects a respective lamp load 120, which is the CCFL 120 in this embodiment, and ground, the secondary current (i2, i2') flows to the CCFL 120 and forms a load circuit loop. After the CCFLs 120 start to discharge, due to their negative thermal impedance characteristics, the impedances vary between individual CCFLs 120. However, the change in magnetic flux in the tertiary winding 35 and that in the secondary winding 34 are in an intrinsic repulsive relationship. Since the tertiary windings 35 of the first and second coil units 7, 7' are interconnected in parallel to form a closed loop, the first and second transformer core units 9, 9' are coupled electromagnetically, so as to establish balanced current outputs to the CCFLs 120, thereby ensuring uniform illumination.

Figure 19:
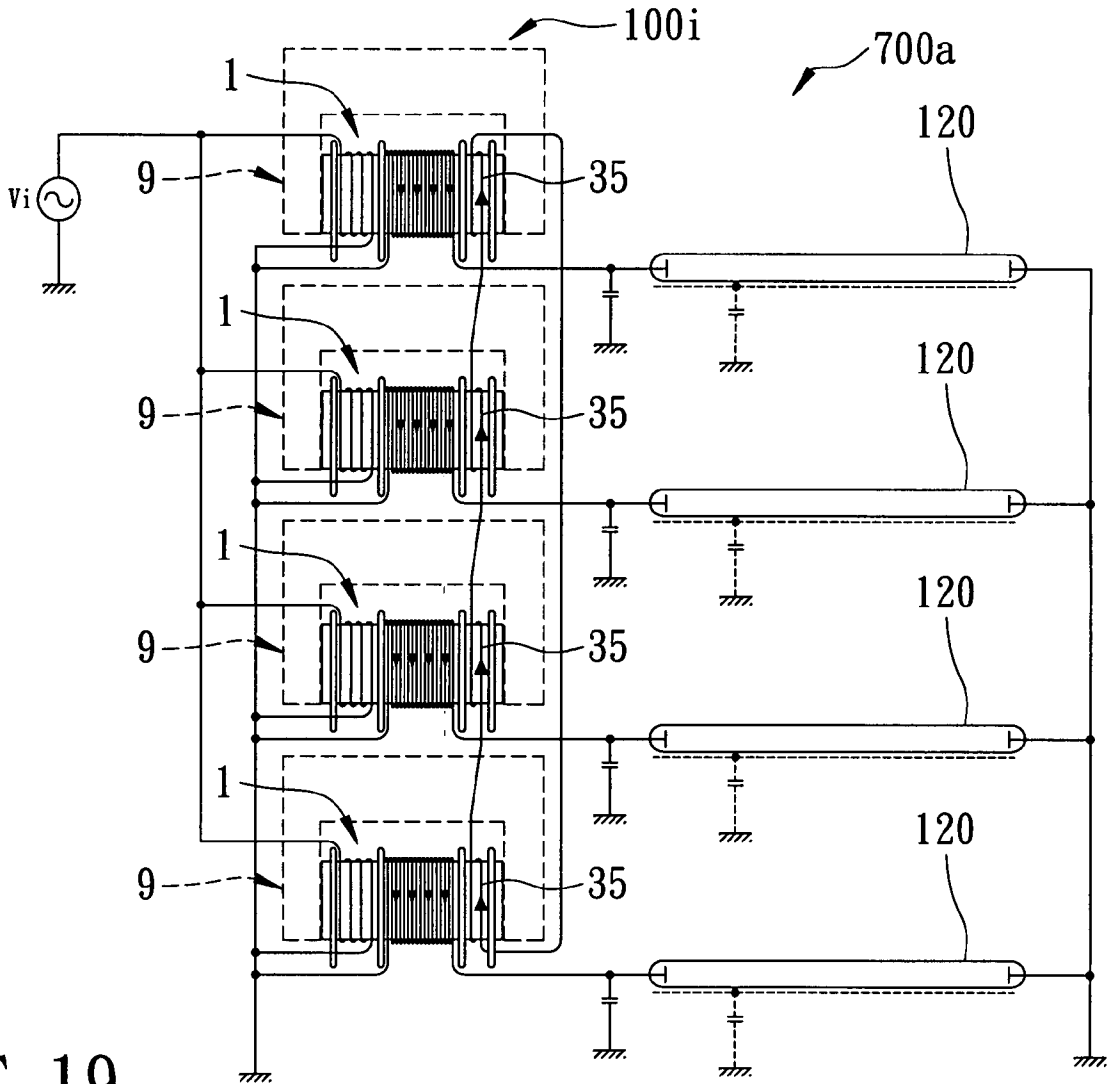
FIG. 19 is a schematic diagram of a lamp assembly according to the eleventh preferred embodiment of the present invention.

As shown in FIG. 19, a lamp assembly 700*a* according to the eleventh embodiment of the present invention includes four lamp loads 120, and an inverter transformer 100*i* that includes four of the coil units and four of the transformer core units 9. The tertiary windings 35 of the coil units are interconnected to form a closed circuit loop. Since the operating principles remain unchanged as compared to those described hereinabove in connection with the tenth preferred embodiment, further details are omitted herein for the sake of brevity.

Figure 20:
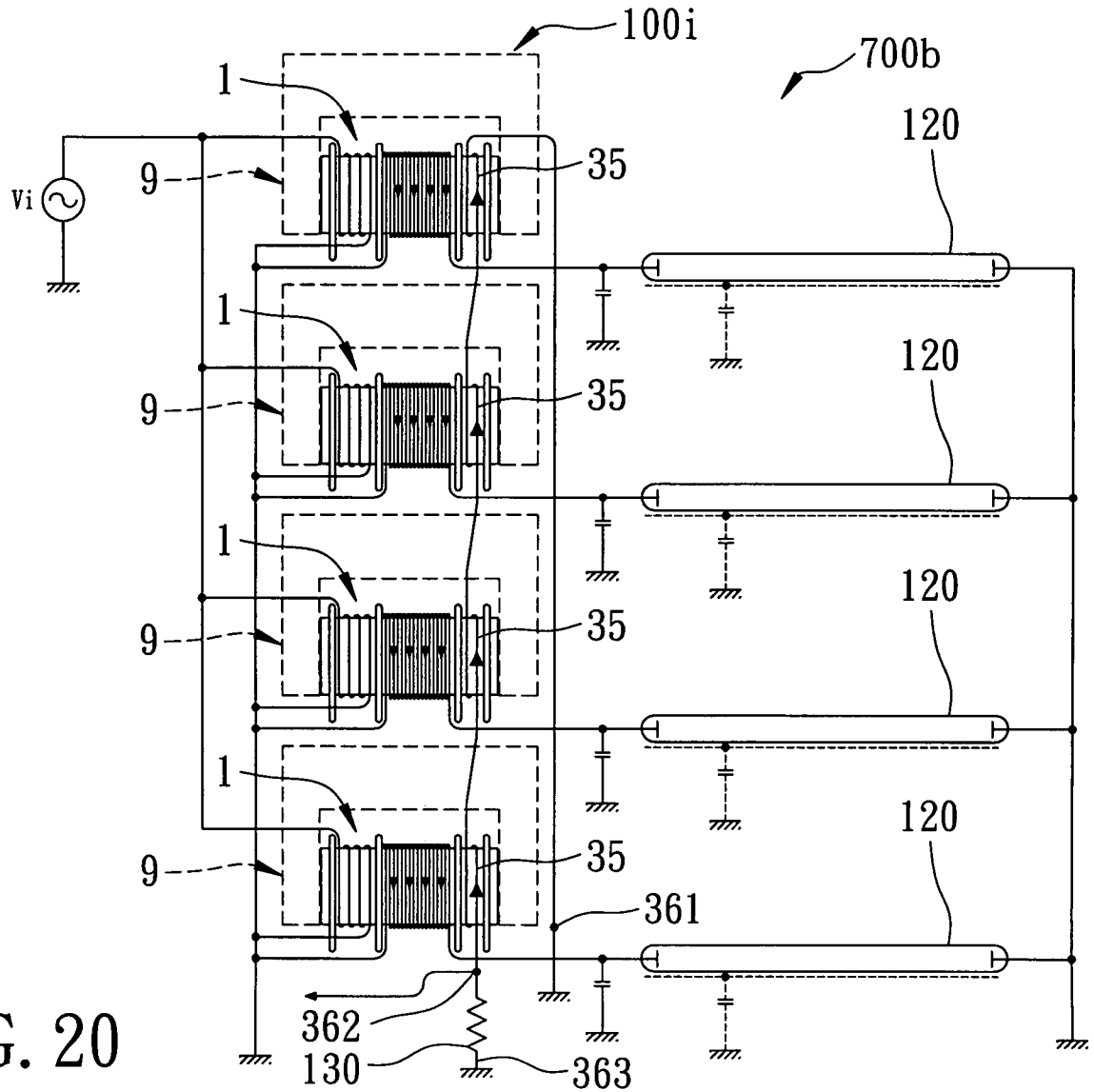
FIG. 20 is a schematic diagram of a lamp assembly according to the twelfth preferred embodiment of the present invention.

As shown in FIG. 20, a lamp assembly 700*b* according to the twelfth preferred embodiment of the present invention differs from the eleventh preferred embodiment in that the lamp assembly 700*b* further comprises an impedance component 130 that forms a part of the closed circuit loop. The impedance component 130 can be resistive, capacitive, or inductive, and is a resistor in this embodiment. In particular, first and second ends 361, 363 of the closed circuit loop are connected directly to ground, and the resistor 130 is connected between the second end 363 and an internal node 362 of the closed circuit loop. The output of the inverter transformer 100*i* can be adjusted by using the internal node 362 as a current detection terminal in cooperation with a drive circuit (not shown), so that the illumination brightness of the CCFLs 120 can be adjusted accordingly. It should be noted herein that the number of impedance components 130 included in the lamp assembly 700*b* depends on a particular application, and should not be limited to one.

Figure 21:
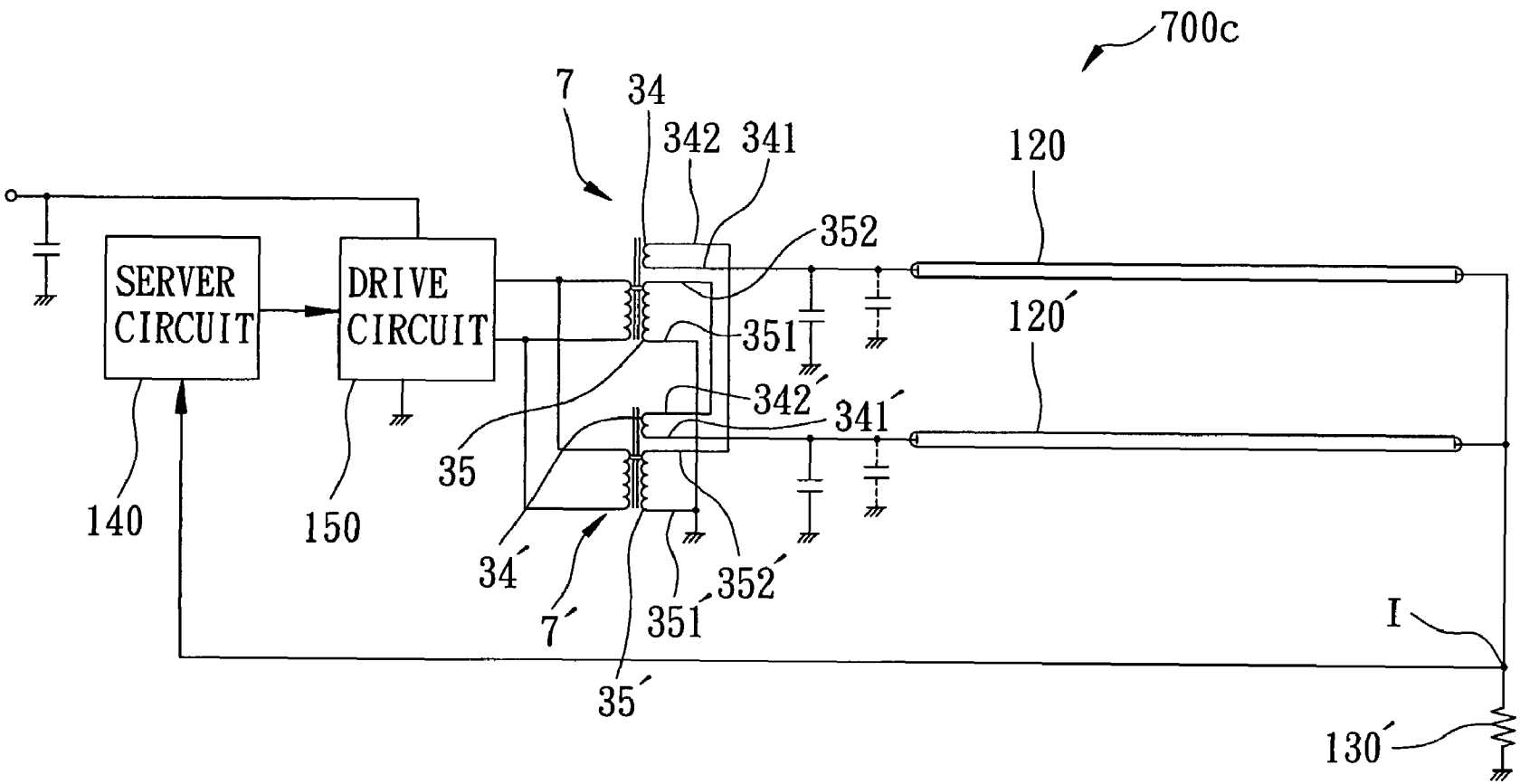
FIG. 21 is a schematic electric circuit diagram of a lamp assembly according to the thirteenth preferred embodiment of the present invention.

As shown in FIG. 21, a lamp assembly 700*c* according to the thirteenth preferred embodiment of the present invention differs from the tenth preferred embodiment (shown in FIG. 17) in that the secondary winding 34 (34') of each of the first and second coil units 7, 7' interconnects in series a respective one of the lamp loads 120 (120') and the tertiary winding 35 (35') of the other one of the first and second coil units 7, 7'.

For the following detailed description of this embodiment, the secondary and tertiary windings of the second coil unit 7' are denoted by 34', 35', and the CCFL connected to the second coil unit 7' is denoted by 120'. In addition, each secondary winding 34 (34') has first and second ends 341 (341'), 342 (342'), while each tertiary winding 35 (35') has third and fourth ends 351 (351'), 352 (352').

In particular, the first end 341 of the secondary winding 34 of the first coil unit 7 is connected to one end of the CCFL 120. The second end 342 of the secondary winding 34 of the first coil unit 7 is connected to the fourth end 352' of the tertiary winding 35' of the second coil unit 7'. The third end 351' of the tertiary winding 35' of the second coil unit 7' is connected directly to ground. The other end of the CCFL 120 is grounded through a resistor 130'. Accordingly, the first end 341' of the secondary winding 34' of the second coil unit 7' is connected to one end of the CCFL 120'. The second end 342' of the secondary winding 34' of the second coil unit 7' is connected to the fourth end 352 of the tertiary winding 35 of the first coil unit 7. The third end 351 of the tertiary winding 35 of the first coil unit 7 is connected directly to ground. The other end of the CCFL 120' is grounded through the resistor 130'.

An internal node (I) between the resistor 130' and the CCFLs 120, 120' acts as a current detection terminal. The potential detected at node (I) is fed back into a server circuit 140 for voltage adjustments, and voltage inputs are fed into the inverter transformer 100*b* through a drive circuit 150, thereby maintaining stable voltage inputs for uniform illumination among the CCFLs 120, 120'.

Figure 22:
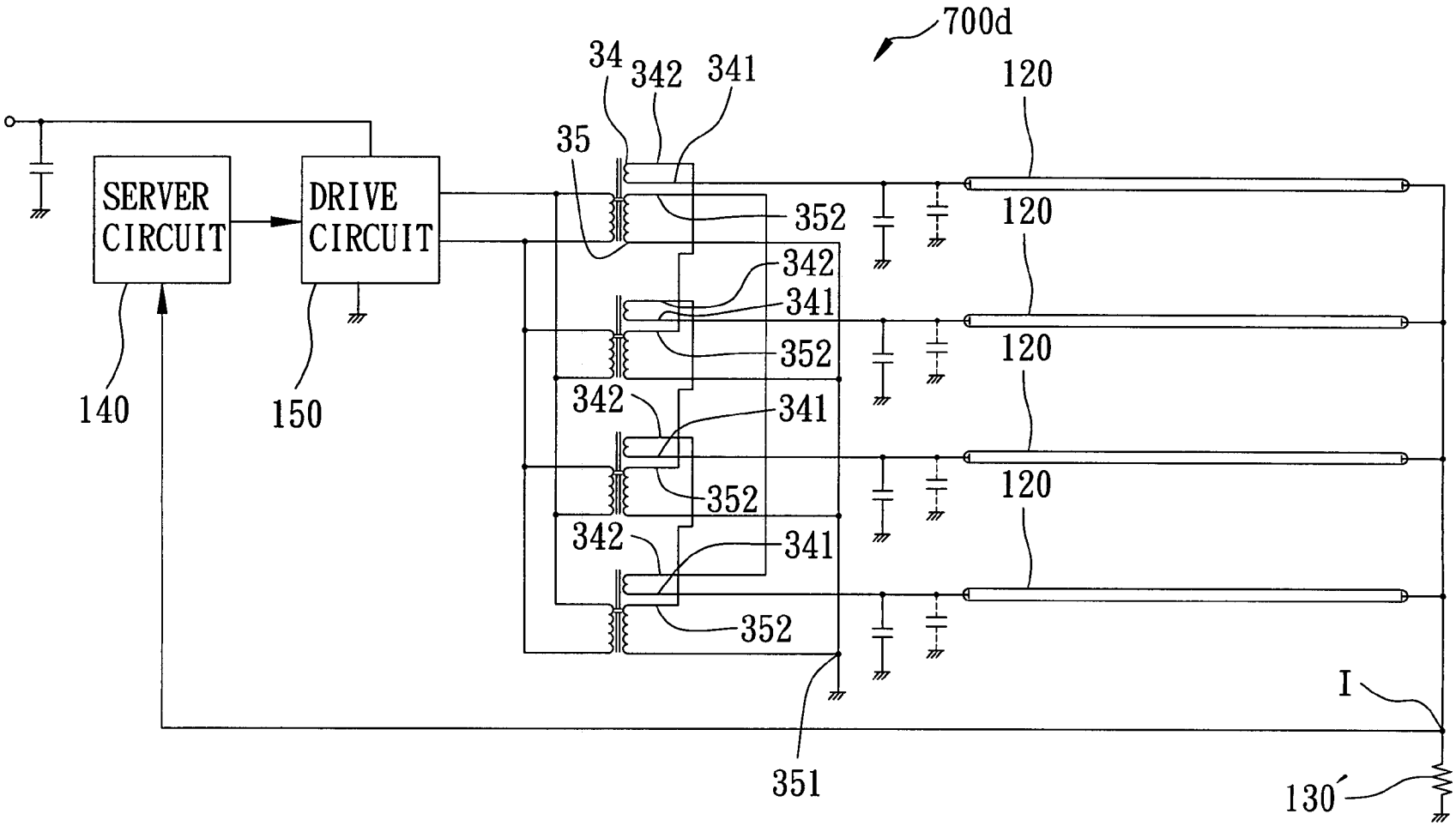
FIG. 22 is a schematic electric circuit diagram of a lamp assembly according to the fourteenth preferred embodiment of the present invention.

As shown in FIG. 22, a lamp assembly 700*d* according to the fourteenth preferred embodiment of the present invention differs from the thirteenth preferred embodiment (shown in FIG. 21) in that there are four lamp loads 120 and the inverter transformer includes four coil units. Since the connections among the CCFLs 120 and the windings 34, 35 of the coil units are in the same manner as those shown in the thirteenth preferred embodiment, further details are omitted herein for the sake of brevity.

Figure 23:
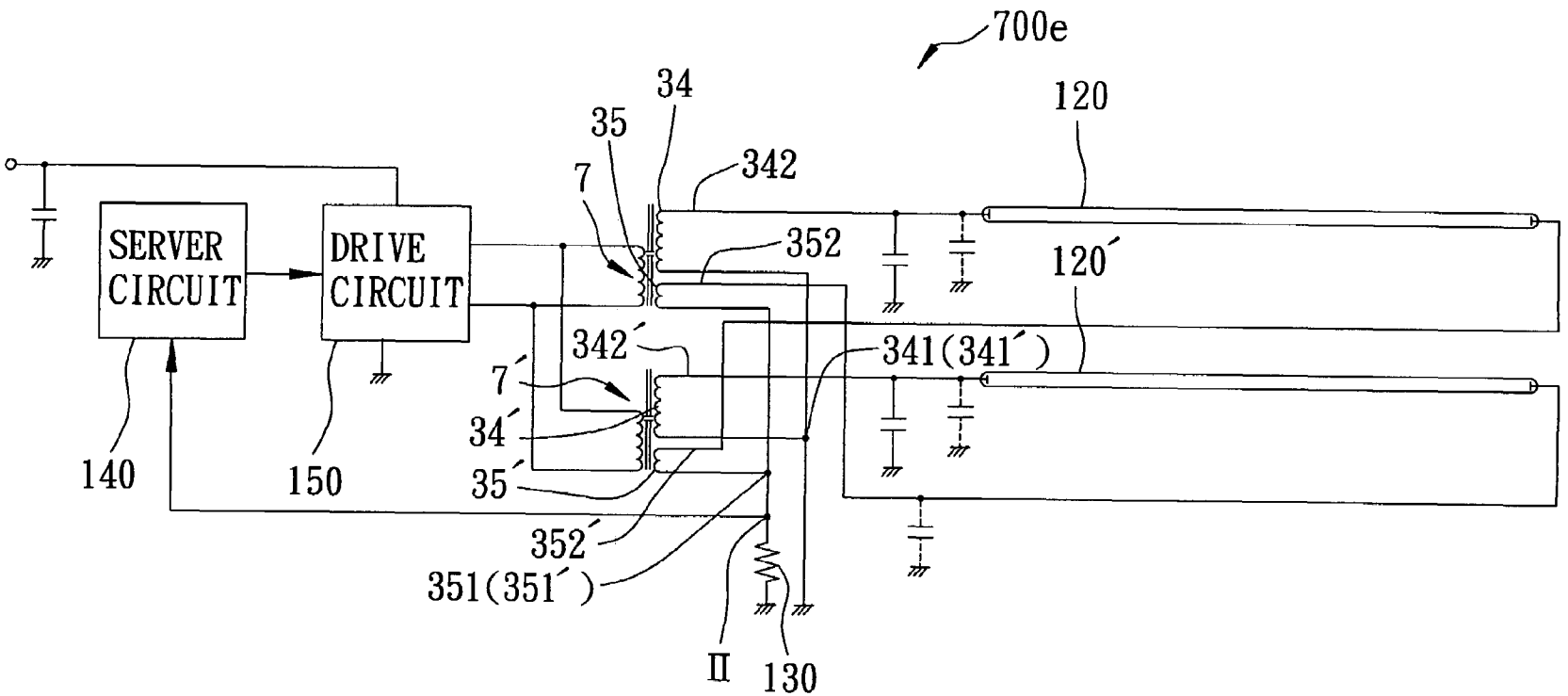
FIG. 23 is a schematic electric circuit diagram of a lamp assembly according to the fifteenth preferred embodiment of the present invention.

As shown in FIG. 23, a lamp assembly 700*e* according to the fifteenth preferred embodiment of the present invention differs from the thirteenth embodiment (shown in FIG. 21) in that each of the CCFLs 120, 120' is connected in series between the secondary winding 34 (34') of the respective one of the first and second coil units 7, 7', and the tertiary winding 35' (35) of the other one of the first and second coil units 7, 7'.

In particular, the CCFL 120 interconnects the second end 342 of the secondary winding 34 of the first coil unit 7, and the fourth end 352' of the tertiary winding 35' of the second coil unit 7'. The first end 341 of the secondary winding 34 of the first coil unit 7 is connected directly to ground. The third end 351' of the tertiary winding 35' of the second coil unit 7' is connected to ground through a resistor 130. Accordingly, the CCFL 120' interconnects the second end 342' of the secondary winding 34' of the second coil unit 7', and the fourth end 352 of the tertiary winding 35 of the first coil unit 7. The first end 341' of the secondary winding 34' of the second coil unit 7' is connected directly to ground. The third end 351 of the tertiary winding 35 of the first coil unit 7 is connected to ground through a resistor 130.

An internal node (II) between the third end 351 (351') and the resistor 130 acts as a current detection terminal. The mechanism in maintaining uniform illumination between the CCFLs 120, 120' is the same as that mentioned in the thirteenth preferred embodiment, so the same are omitted herein for the sake of brevity.

Figure 24:
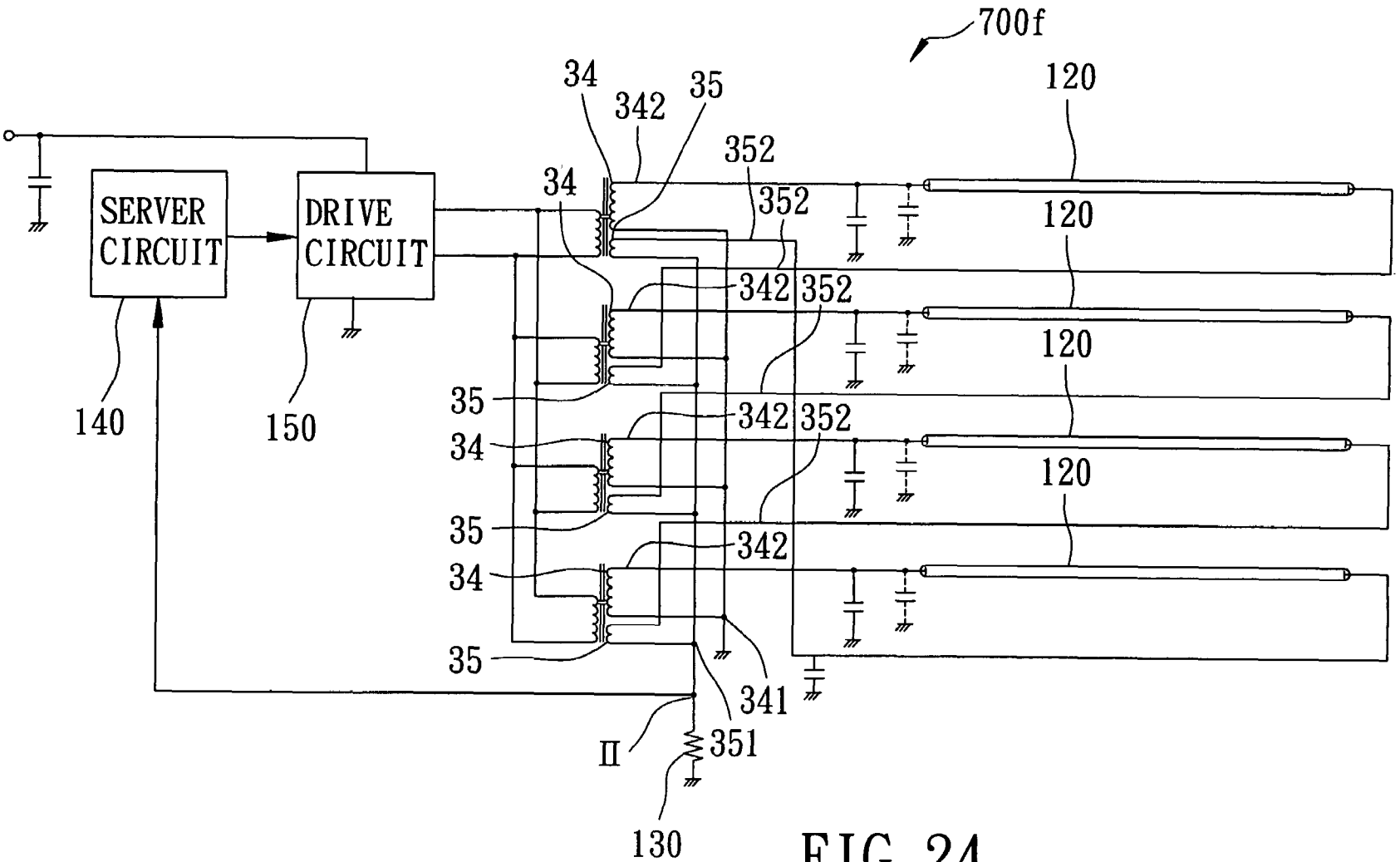
FIG. 24 is a schematic electric circuit diagram of a lamp assembly according to the sixteenth preferred embodiment of the present invention.

As shown in FIG. 24, a lamp assembly 700*f* according to the sixteenth preferred embodiment of the present invention differs from the fifteenth preferred embodiment in that there are four lamp loads 120 and the inverter transformer includes four coil units. Since the connections among the CCFLs 120 and the windings 34, 35 of the coil units are in the same manner as those shown in the fifteenth preferred embodiment, further details are omitted herein for the sake of brevity.

Figure 25:
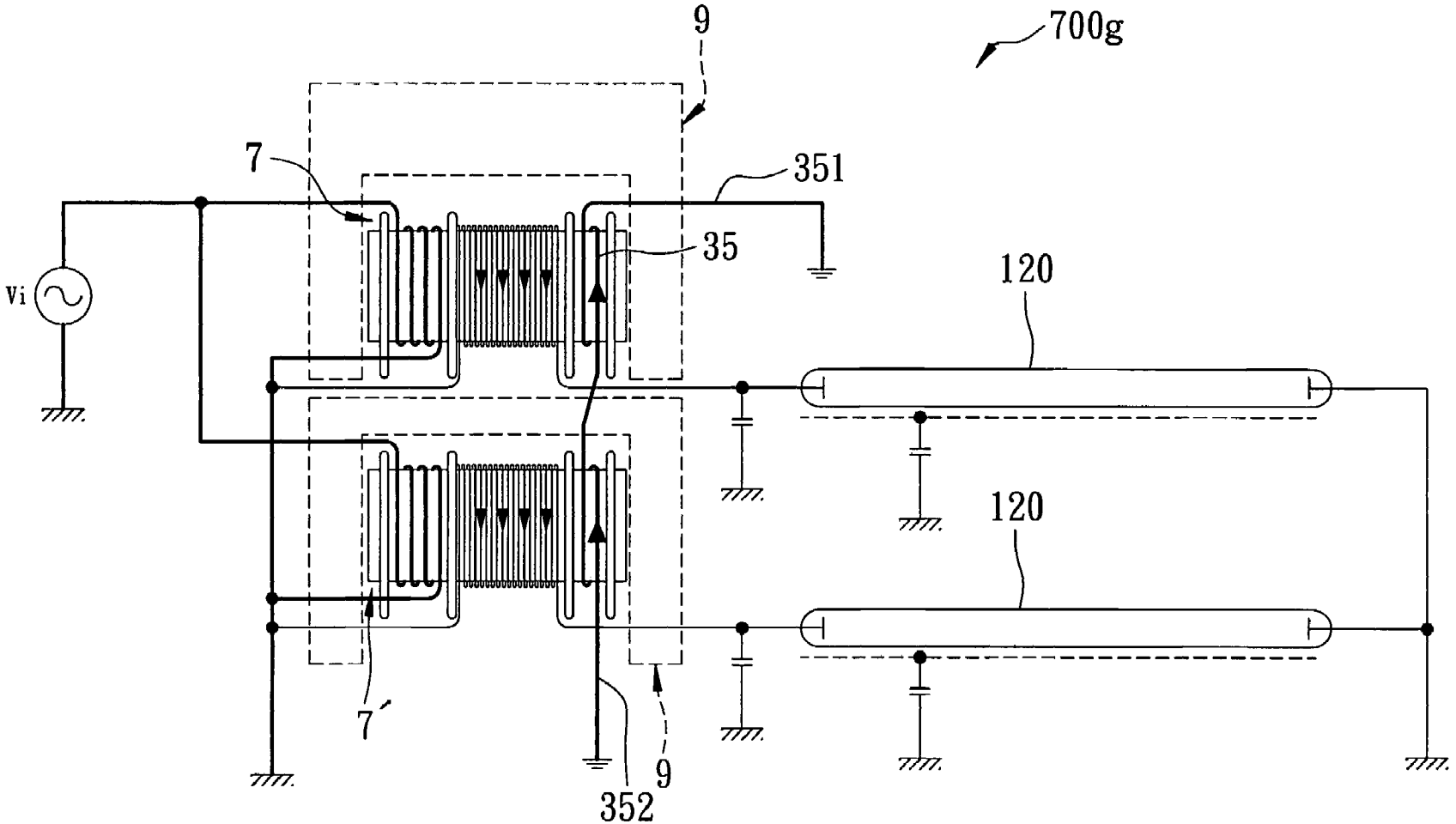
FIG. 25 is a schematic diagram of a lamp assembly according to the seventeenth preferred embodiment of the present invention.

As shown in FIG. 25, a lamp assembly 700*g* according to the seventeenth preferred embodiment of the present invention differs from the tenth preferred embodiment (shown in FIG. 17) in that the tertiary windings 35 of the first and second coil units 7, 7' are connected in series, where two ends 351, 352 are to grounded to form a closed circuit loop.

Therefore, as illustrated in the tenth to the seventeenth preferred embodiments, the present invention utilizes the intrinsic repulsive relationship between magnetic fluxes of the secondary and tertiary windings 34, 35 in each of the coil units 7 to ensure balanced current outputs to the CCFLs 120 in the lamp assembly, thereby ensuring uniform illumination. In addition, as illustrated in the twelfth to the sixteenth preferred embodiments, the lamp assembly can further include the resistor 130 for detection of potential, which can be fed back to the server circuit 140 for voltage adjustments, so as to maintain stable voltage inputs into the lamp assembly for uniform illumination among the CCFLs 120.

Figure 26:
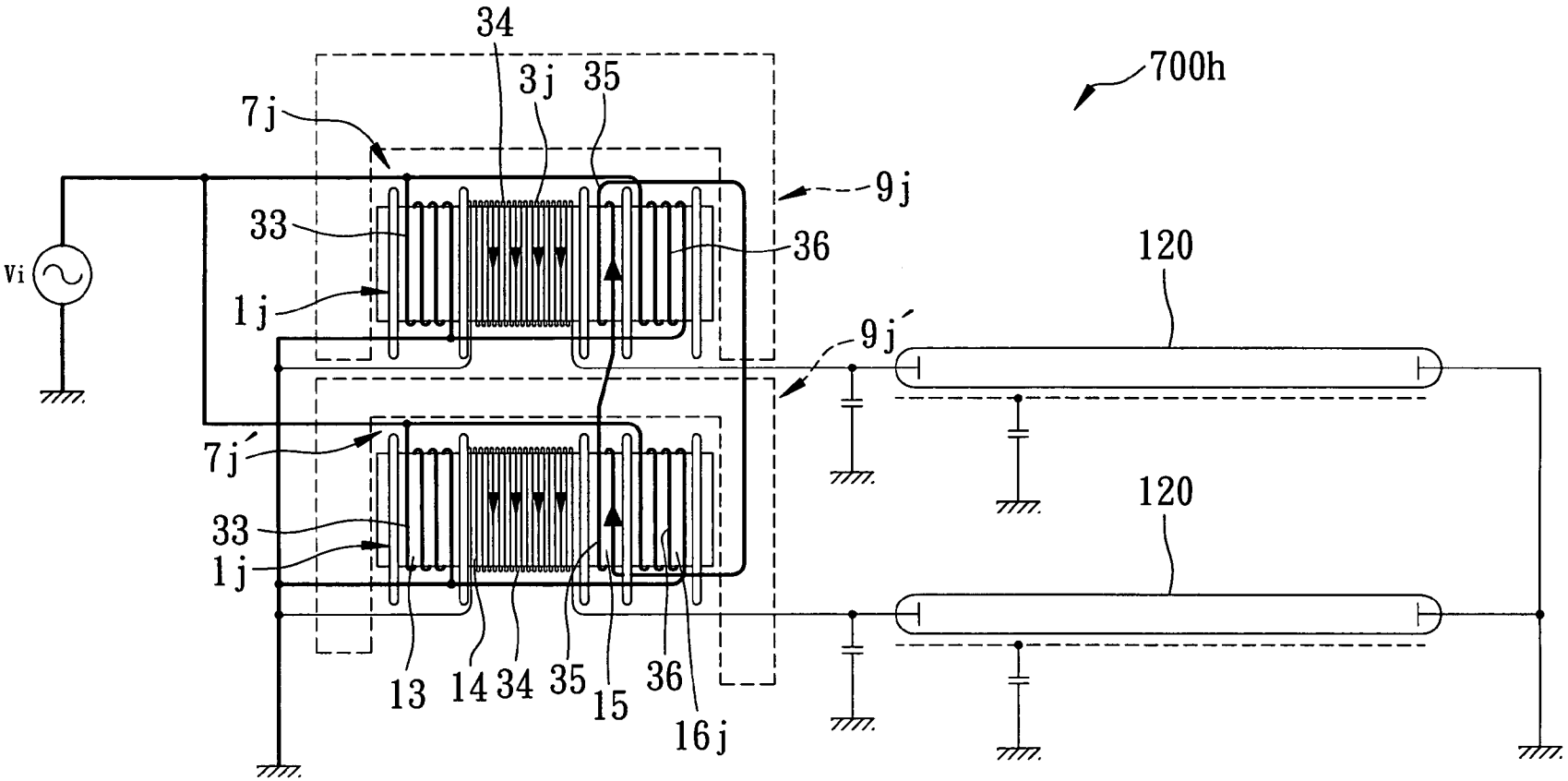
FIG. 26 is a schematic diagram of a lamp assembly according to the eighteenth preferred embodiment of the present invention.

As shown in FIG. 26, a lamp assembly 700*h* according to the eighteenth preferred embodiment of the present invention differs from the tenth preferred embodiment (shown in FIG. 17) in that the bobbin 1*j* of each of the coil units 7*j*, 7*j'* further includes a fourth coil winding portion 16*j* disposed adjacent to the third coil winding portion 15, and the windings 3*j* include a pair of the primary windings 33, 36 wound around the first and fourth coil winding portions 13, 16*j*, respectively. Due to the intrinsic repulsive relationship between the first and tertiary windings 36, 35, and between the secondary and tertiary windings 34, 35, and since the tertiary windings 35 of the first and second coil units 7*j*, 7*j'* are connected in parallel to form a closed loop, the first and second transformer core units 9*j*, 9*j'* are coupled electromagnetically. Therefore, balanced current outputs to the CCFLs 120 are established, thereby ensuring uniform illumination.

While the present invention has been described in connection with what is considered the most practical and preferred embodiments, it is understood that this invention is not limited to the disclosed embodiments but is intended to cover various arrangements included within the spirit and scope of the broadest interpretation and equivalent arrangements.

What is claimed is:

1. An inverter transformer comprising a coil unit including:

a bobbin formed with a core-receiving compartment, and including first, second and third coil winding portions and a plurality of windings wound around said first, second and third coil winding portions, respectively; and a transformer core unit having an internal core part that extends into said core-receiving compartment;

wherein said windings include primary, secondary and tertiary windings wound around said first, second and third coil winding portions, respectively;

wherein said bobbin includes a plurality of said second coil winding portions, and said windings include a plurality of said secondary windings that are wound around said second coil winding portions, respectively; and wherein said bobbin includes a fourth coil winding portion disposed between an adjacent pair of said second coil winding portions, and said windings include a pair of said primary windings that are wound around said first and fourth coil winding portions, respectively.

2. An inverter transformer comprising:

a plurality of coil units, each including a bobbin formed with a core-receiving compartment, and including first, second and third coil winding portions, and a plurality of windings including primary, secondary and tertiary windings wound around said first, second and third coil winding portions, respectively; and a plurality of transformer core units, each having an internal core part that extends into said core-receiving compartment of a respective one of said coil units, said tertiary windings of said coil units being interconnected to form a closed circuit loop.

3. The inverter transformer as claimed in claim 2, further comprising an impedance component that forms a part of said closed circuit loop.

4. The inverter transformer as claimed in claim 2, wherein said bobbin includes a fourth coil winding portion, and said windings include a pair of said primary windings that are wound around said first and fourth coil winding portions, respectively.

5. A lamp assembly comprising a pair of lamp loads;

an inverter transformer including first and second coil units connected respectively to said lamp loads, each of said first and second coil units including a bobbin formed with a core-receiving compartment, and including first, second and third coil winding portions, a plurality of windings including primary, secondary and tertiary windings wound around said first, second and third coil winding portions, respectively, and first and second transformer core units, each having an internal core part that extends into said core-receiving compartment of a respective one of said first and second coil units; and wherein secondary winding of each of said first and second coil units interconnects in series the respective one of said lamp loads and said tertiary winding of the other one of said first and second coil units.

6. A lamp assembly comprising a pair of lamp loads;

an inverter transformer including first and second coil units connected respectively to said lamp loads, each of said first and second coil units including a bobbin formed with a core-receiving compartment, and including first, second and third coil winding portions, a plurality of windings including primary, secondary and tertiary windings wound around said first, second and third coil winding portions, respectively, and first and second transformer core units, each having an internal core part that extends into said core-receiving compartment of a respective one of said first and second coil units; and wherein each of said lamp loads is connected in series between said secondary winding of the respective one of said first and second coil units, and said tertiary winding of the other one of said first and second coil units.

* * * * *